US009925564B2

(12) United States Patent
Eastman

(10) Patent No.: US 9,925,564 B2
(45) Date of Patent: Mar. 27, 2018

(54) FLUIDIZED AGGREGATE SEPARATION SYSTEM

(71) Applicant: Fluidized Rock Systems, Inc., Lake Worth, FL (US)

(72) Inventor: Bernard Eastman, Lake Worth, FL (US)

(73) Assignee: Fluidized Rock Systems, Inc., Lake Worth, FL (US)

( * ) Notice: Subject to any disclaimer, the term of this patent is extended or adjusted under 35 U.S.C. 154(b) by 0 days.

(21) Appl. No.: 15/193,534

(22) Filed: Jun. 27, 2016

(65) Prior Publication Data

US 2017/0080461 A1 Mar. 23, 2017

Related U.S. Application Data

(60) Provisional application No. 62/221,943, filed on Sep. 22, 2015.

(51) Int. Cl.
*B07B 13/16* (2006.01)
*B07B 1/00* (2006.01)
(Continued)

(52) U.S. Cl.
CPC ..... *B07B 1/005* (2013.01); *B07B 1/36* (2013.01); *B07B 11/06* (2013.01); *B07B 13/16* (2013.01);
(Continued)

(58) Field of Classification Search
CPC .. B07B 1/005; B07B 1/30; B07B 7/06; B07B 9/00; B07B 11/06; E02F 3/94; E02F 5/226; E02F 7/06; E01H 12/00
See application file for complete search history.

(56) References Cited

U.S. PATENT DOCUMENTS 1,465,986 A * 8/1923 Johnson ..... B07B 13/00 209/358
2,381,172 A * 8/1945 Lundberg ..... A01D 33/08 15/309.2
(Continued)

FOREIGN PATENT DOCUMENTS

DE 6928459 12/1969
DE 3005669 10/1981
(Continued)

OTHER PUBLICATIONS

English Translation of DE 6928459, Date: Dec. 1969, Applicant: Zimmerman & Jansen GMBH.*
(Continued)

*Primary Examiner* — Joseph C Rodriguez
(74) *Attorney, Agent, or Firm* — Burr & Forman LLP; Jeffrey H. Kamenetsky

(57) ABSTRACT

A fluidized aggregation separation system including an intake assembly having a first and a second end, and a separation assembly configured to separate material larger than a predetermined size from material smaller than the predetermined size. The separation assembly includes a screen assembly configured to prevent the material larger than the predetermined size from passing through the screen assembly and to allow the material smaller than the predetermined size to pass through the screen assembly. The fluidized aggregation separation system also includes an exit assembly configured to direct the material smaller than the predetermined size towards a restoration area.

16 Claims, 6 Drawing Sheets

(51) Int. Cl.

| | |
|---|---|
| ***B07B 1/36*** | (2006.01) |
| ***B07B 11/06*** | (2006.01) |
| *B07B 9/00* | (2006.01) |
| *E02B 3/04* | (2006.01) |

(52) U.S. Cl.
CPC ..... *B07B 9/00* (2013.01); *B07B 2230/01* (2013.01); *E02B 3/04* (2013.01)

(56) References Cited

U.S. PATENT DOCUMENTS

| | | | | | |
|---|---|---|---|---|---|
| 2,775,438 | A * | 12/1956 | Bach | E01B 27/10 | 171/1 |
| 3,930,324 | A * | 1/1976 | Wightman | E02F 3/8825 | 324/243 |
| 4,017,281 | A * | 4/1977 | Johnstone | B01D 46/0057 | 15/340.1 |
| 4,033,470 | A | 7/1977 | Venus et al. | | |
| 4,276,158 | A * | 6/1981 | Gorlitz | B07B 1/46 | 209/255 |
| 4,366,052 | A * | 12/1982 | Cloutier | E01H 12/006 | 210/199 |
| 4,574,420 | A * | 3/1986 | Dupre | E01H 1/0836 | 15/331 |
| 4,824,285 | A | 4/1989 | Trierweiler | | |
| 5,020,858 | A | 6/1991 | Nishikawa | | |
| 5,430,962 | A * | 7/1995 | Osadchuk | B07B 1/005 | 209/241 |
| 5,487,229 | A * | 1/1996 | Nathenson | E02F 3/925 | 175/67 |
| 5,975,441 | A | 11/1999 | Burkholder | | |
| 6,044,977 | A * | 4/2000 | Csendes | B01D 45/14 | 209/23 |
| 6,098,812 | A | 8/2000 | Douglas | | |
| 6,186,338 | B1 | 2/2001 | Douglas | | |
| 6,382,425 | B1 | 5/2002 | Brickner et al. | | |
| 6,789,337 | B2 | 9/2004 | Mallaghan | | |
| 7,104,403 | B1 * | 9/2006 | Stephens | B07B 7/04 | 209/132 |
| 7,559,962 | B2 * | 7/2009 | Miller | B07B 11/06 | 55/319 |
| 7,841,422 | B1 | 11/2010 | Chavez et al. | | |
| 8,464,874 | B2 | 6/2013 | Whitley et al. | | |
| 8,752,710 | B2 | 6/2014 | Frost | | |
| 2005/0134102 | A1 | 6/2005 | Cymerman et al. | | |
| 2010/0196129 | A1 * | 8/2010 | Buckner | E02F 3/94 | 414/467 |
| 2015/0108046 | A1 * | 4/2015 | Sauser | B07B 1/28 | 209/315 |

FOREIGN PATENT DOCUMENTS

| | | | |
|---|---|---|---|
| JP | H11207395 | A | 8/1999 |
| WO | 2004079099 | A1 | 9/2004 |

OTHER PUBLICATIONS

International Search Report and Written Opinion dated Dec. 22, 2016 for International Application Serial No. PCT/US2016/046341, filed Aug. 10, 2016 consisting of 20-pages.

* cited by examiner

FLUIDIZED AGGREGATE SEPARATION SYSTEM

CROSS-REFERENCE TO RELATED APPLICATION

This application is related to and claims priority to U.S. Provisional Patent Application Ser. No. 62/221,943, filed Sep. 22, 2015, entitled "FLUIDIZED ROCK SCREENING SYSTEM", the entirety of which is incorporated herein by reference.

STATEMENT REGARDING FEDERALLY SPONSORED RESEARCH OR DEVELOPMENT n/a

TECHNICAL FIELD

The present disclosure relates to a restoration system and, specifically, to a fluidized aggregate separation system that continuously pumps an aggregate mixture to a restoration site, separates and removes foreign debris, such as oversized rocks from the aggregate mixture via the use of a screening box, and deposits the remaining sand and water mixture on the target beach site. The large rocks can be transferred to a remote location away from the restoration area.

BACKGROUND

A beach restoration or beach nourishment project involves depositing and/or pumping sand from a remote site onto an eroding shoreline in order to upgrade and widen the existing beach. The State of Florida has standards that require that, during a beach restoration or nourishment project, the material placed on the beach must be no larger than three quarters of an inch. Often, the project is designed to use offshore borrow areas in order to replenish the beach. Many times, dredge companies encounter stone and large shell particles, which wind up on the beach. Rock boxes, placed at the end of a discharge pipe located on the beach quickly fill up with oversized rocks. Many times these rock boxes rapidly fill up with larger stones carried by the water from the top of the rock box which still allows the beach to be contaminated with the larger stones. Dredge companies need to frequently stop the process in order to clean out the filled rock boxes. This requires a large amount of downtime, which significantly slows down the restoration process.

SUMMARY

The present disclosure advantageously provides a fluidized aggregation separation system for receiving aggregate formed of a liquid such as water, and debris or other material from an offsite borrow area, separating larger material from the aggregate and allowing smaller material and liquid to be directed toward an area in need of restoration, while continuously removing the oversized material to a location away from the restoration site.

In one aspect of the disclosure, a fluidized aggregation separation system is provided, where the system includes an intake assembly having a first and a second end, and a separation assembly configured to separate material larger than a predetermined size from material smaller than the predetermined size. In one embodiment, the separation assembly includes a screen assembly configured to prevent the material larger than the predetermined size from passing through the screen assembly and to allow the material smaller than the predetermined size to pass through the screen assembly. In this aspect, the system also includes an exit assembly configured to direct the material smaller than the predetermined size towards a restoration area.

In another aspect of the disclosure, a fluidized aggregation separation system is provided where the system includes at least one aggregate intake conduit, each having a first and a second end, the first end of each intake conduit configured to receive aggregate from a remote location, the aggregate including material larger than a predetermined size and material smaller than the predetermined size, a velocity reduction chamber configured to receive the aggregate from the second end of each of the at least one aggregate intake conduit, the velocity reduction chamber configured to reduce a velocity of the aggregate and to redirect the aggregate, and a separation assembly configured to separate the material larger than the predetermined size from the material smaller than the predetermined size. In one embodiment, the separation assembly includes a movable screen assembly configured to prevent the material larger than the predetermined size from passing through the screen assembly and to allow the material smaller than the predetermined size to pass through the screen assembly. In this aspect, the system also includes a deflector assembly configured to direct the material smaller than the predetermined size towards a restoration area, and an exit assembly configured to transport the material smaller than the predetermined size towards the restoration area.

In another aspect of the disclosure, a fluidized aggregation separation system is provided and includes an intake conduit having a first and a second end, the first end configured to receive aggregate from a remote location, the aggregate including material larger than a predetermined size and smaller than the predetermined size. In this aspect, the system further includes a velocity reduction chamber configured to receive the aggregate from the second end of intake conduit, the velocity reduction chamber configured to reduce a velocity of the aggregate and to redirect the aggregate, and a separation assembly configured to separate the material larger than the predetermined size from the material smaller than the predetermined size. In one embodiment, the separation assembly includes a movable screen assembly configured to distribute the aggregate and to prevent the material larger than the predetermined size from passing through the screen assembly and to allow the material smaller than the predetermined size to pass through the screen assembly. In this aspect, the system also includes a deflector assembly configured to direct the material smaller than the predetermined size towards a restoration area. In one embodiment, the deflector assembly includes an upper deck and a lower deck, the upper deck including a plurality of substantially vertical deflectors configured to guide the material smaller than the predetermined size down into the lower deck, the lower deck including a plurality of angled deflectors positioned to deflect the material smaller than the predetermined size towards the restoration area. In this aspect, the system also includes an exit assembly configured to transport the material smaller than the predetermined size towards the restoration area, and a material conveyor configured to receive the material larger than the predetermined size from the separation assembly and to continually transport the material larger than the predetermined size away from the restoration area.

BRIEF DESCRIPTION OF THE DRAWINGS

A more complete understanding of the present disclosure, and the attendant advantages and features thereof, will be more readily understood by reference to the following detailed description when considered in conjunction with the accompanying drawings wherein.

DETAILED DESCRIPTION

The fluidized aggregate separation system of the present disclosure provides an efficient and effective system for replenishing, restoring, or nourishing areas, such as a beach, or an eroding shoreline or a landfill area (collectively referred to as "restoration site" or "restoration area"), with material that excludes oversized or unwanted material that might be hazardous, dangerous or in violation of environmental standards. The fluidized aggregate separation system of present disclosure also provides a way to salvage foreign debris from an ocean, lake or river, such as, for example, coal or ammunition that had been previously dumped in the water, either intentionally or unintentionally. The fluidized aggregate separation system described herein provides for the intake of the foreign debris (also referred to herein as "aggregate"), i.e., liquid and material, from a borrow area, often offshore, the separation and removal of oversized and/or unwanted material from the aggregate, and the redirecting of the separated aggregate, which includes liquid and smaller material, onto an area in need of restoration. The term "liquid" and "water" are used interchangeably throughout this disclosure, it being understood that water or any other type of liquid may form part of the aggregate mixture. Via the use of a separation assembly, oversized material can be separated from the intake aggregate and continuously transported to a discharge conveyor where the oversized material can be removed from the conveyor to a haul truck or other receptacle. The oversized material can then be taken away to a location away from the restoration area. The remaining or separated aggregate, which includes material small enough to pass through the separation assembly, is directed directly to the restoration area.

Figure 1:
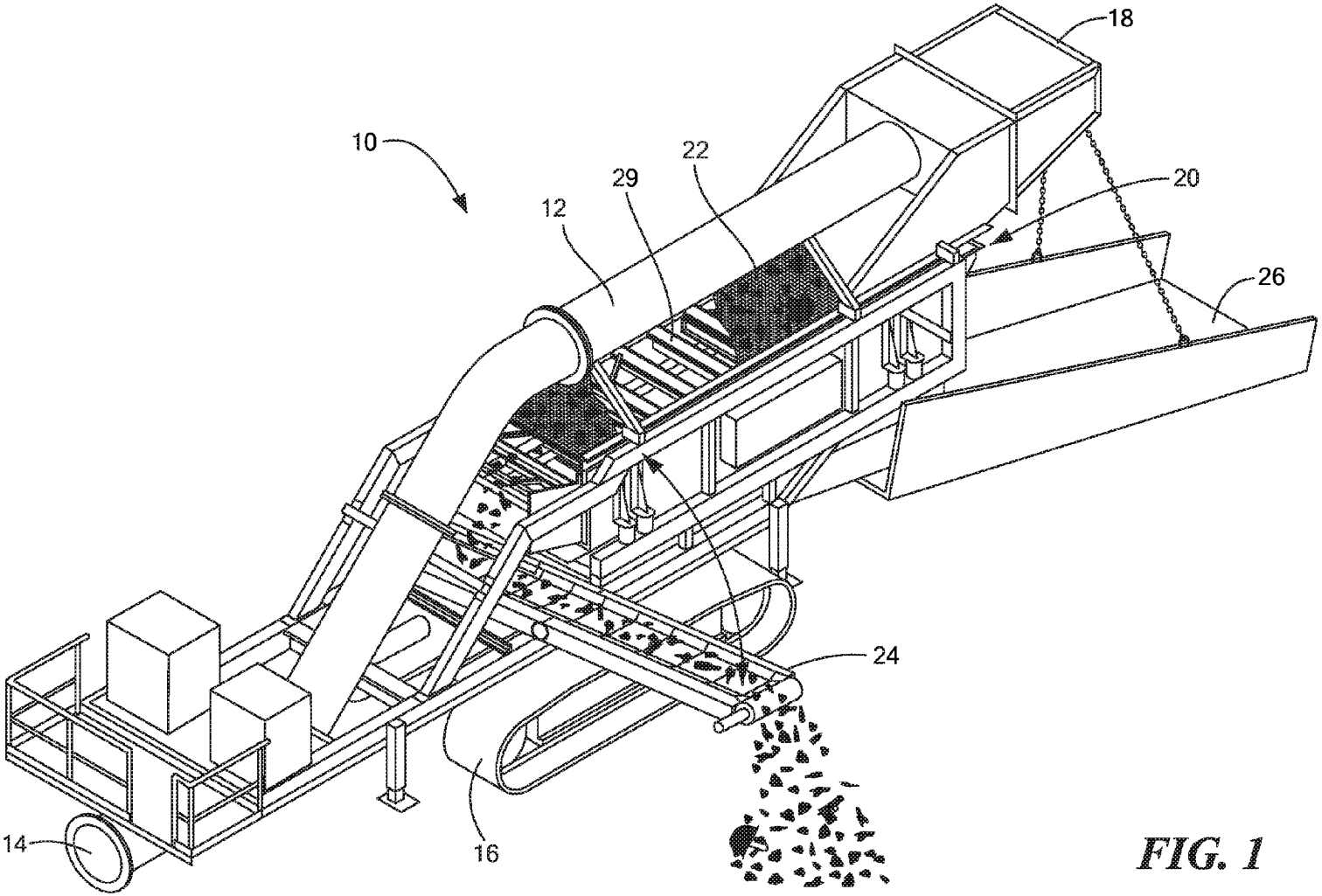
FIG. 1 is a perspective cut away view of the fluidized aggregate separation system of the present disclosure.

FIG. 1 illustrates a cut-away perspective view of the fluidized aggregate separation system 10 of the present disclosure. The fluidized aggregate separation system 10 includes an intake assembly 12, that includes conduit such as piping, that receives water (or other liquid), sand, debris, rocks and other material (referred to as "aggregate") from a borrow area. The borrow area can be, for example, an offshore site. An open end of intake assembly 12 may be connected to one or more additional conduits in order to extend the coverage area of the fluidized aggregate separation system 10 and allow for aggregate to be obtained from a greater distance via a connected series of conduit.

For example, if the restoration area is a beach, a series of pipes may be attached to the open end 14 of intake assembly 12 and extend out into the ocean or a lake or any body of water where aggregated can be collected, or "dredged." The act of dredging, as commonly known in the art, is the act of excavating submerged or saturated sediment from one location and transporting it to another. During extraction, energy is applied to the sediment by mechanical and/or hydraulic means to alter sediment physical characteristics. Mechanical dredges generally use some type of bucket for digging the sediment, and a hoist or a boom the load to the surface. Hydraulic methods may use a centrifugal pump in converting kinetic energy into a pressure gradient to create a water flow that erodes and entrains sediment into a slurry aggregate (water and sediment mixture). The sediment is transported from the dredge site to placement area by hydraulic or mechanical methods. Thus, for example, a pump such as a hydraulic pump mounted to an engine which drives the pump, as commonly known in the art, can be used to pump the aggregate from the borrow area to the restoration area. Thus, intake assembly 12 of fluidized aggregate separation system 10 receives the aggregate from the borrow area, the aggregate including water and material, where, depending upon the capacity of the pump, the aggregate could be entering the intake assembly 12 at high velocity. Fluidized aggregate separation system 10 may be equipped to travel along the ground via a movement assembly 16 such as for example, wheels, tracks or other locomotion arrangements commonly known in the art. Advantageously, this allows fluidized aggregate separation system 10 to be moved along, for example, a stretch of beach, where there are multiple areas in need of restoration. After a sufficient about of sand and other material is deposited on a first restoration site, fluidized aggregate separation system 10 can be moved along the sand to the next restoration site, additional piping coupled to the open end 14 of intake assembly 12 in order to increase the coverage area of fluidized aggregate separation system 10, and the aggregate separation process, which will be described below in more detail, repeated.

Referring again to FIG. 1, aggregate obtained from the borrow site is pumped through intake assembly 12. In one embodiment, intake assembly 12 includes a first substantially horizontal portion and an upward angled elbow portion, followed by a second substantially horizontal portion, as shown in FIG. 1. The aggregate travels up through intake assembly until it reaches velocity reduction chamber 18. As will be discussed in greater detail below, velocity reduction chamber 18 serves to redirect the incoming aggregate mixture from intake assembly 12 to a separation assembly 20, and to reduce the velocity of the incoming aggregate in order to facilitate the spreading of the aggregate more evenly across a screen assembly 22 of separation assembly 20. Depending upon the capacity of the pump and engine used to extract aggregate from the offsite borrow area, the aggregate might be traveling within the conduit of intake assembly 12 at high speeds. Because larger material needs to be separated from the aggregate by separation assembly 20, velocity reduction chamber 18 advantageously serves to redirect and slow the flow of the aggregate. In this fashion, the aggregate enters separation assembly 20 at a slower rate to allow separation assembly 20 to separate oversized material from the aggregate mixture. In this disclosure "oversized material" shall mean material from the aggregate that is greater than a predetermined size while "undersized material" shall mean material from the aggregate smaller than the predetermined size. The operations of separation assembly 20 are described in greater detail below.

Fluidized aggregate separation system 10 may also include an oversized material exit ramp 24. Oversized material exit ramp 24 receives oversized material from the aggregate mixture exiting separation assembly 20 and removes the oversized material from fluidized aggregate separation system 10. In one embodiment, oversized material exit ramp 24 includes a conveyor belt placed over a skirting which receives oversized material from separation assembly 20 and transfers the oversized material away from fluidized aggregate separation system 10. For example, a bin could be located beneath the end of oversized material exit ramp 24 in order to capture the oversized material. In other embodiments, a vehicle could receive the oversized material and transport the oversized material to a different location. In one embodiment, oversized material exit ramp 24 may be raised or lowered depending upon the height and dimensions of the haul truck or receptacle that is to receive the oversized rocks from the conveyor. In another embodiment, oversized material exit ramp 24 may be raised to any height up to a vertical orientation, when not in use. When raised to a vertical or near vertical position, fluidized aggregate separation system 10 can adopt a more narrow footprint while in motion, from, for example, one site to another site, thus facilitating movement.

Fluidized aggregate separation system 10 may also include exit assembly 26. Exit assembly 26 includes an elongated chute or ramp situated underneath screen assembly 22 in order to collect the liquid and undersized material (referred to as "separated aggregate") exiting screen assembly 22 after the oversized material has been trapped above screen assembly 22. The separated aggregate falls into the exit assembly 26 and is deposited at the restoration site. In one embodiment, exit assembly 26 as shown in FIG. 1 may be angled downwards towards the restoration area in order to facilitate the flow of the liquid and undersized material of the separated aggregate towards the restoration site. Although the flow of water and debris pumped into intake assembly 12 is slowed by velocity reduction chamber 18, the speed of the water and separated aggregate flowing beneath screen assembly 22 may be sufficient to allow the separated aggregate to flow along exit assembly 26 towards the restoration site. In one embodiment, rubber curtains may be configured to prevent undermining and erosion at the discharge end of exit assembly 26.

Figure 2:
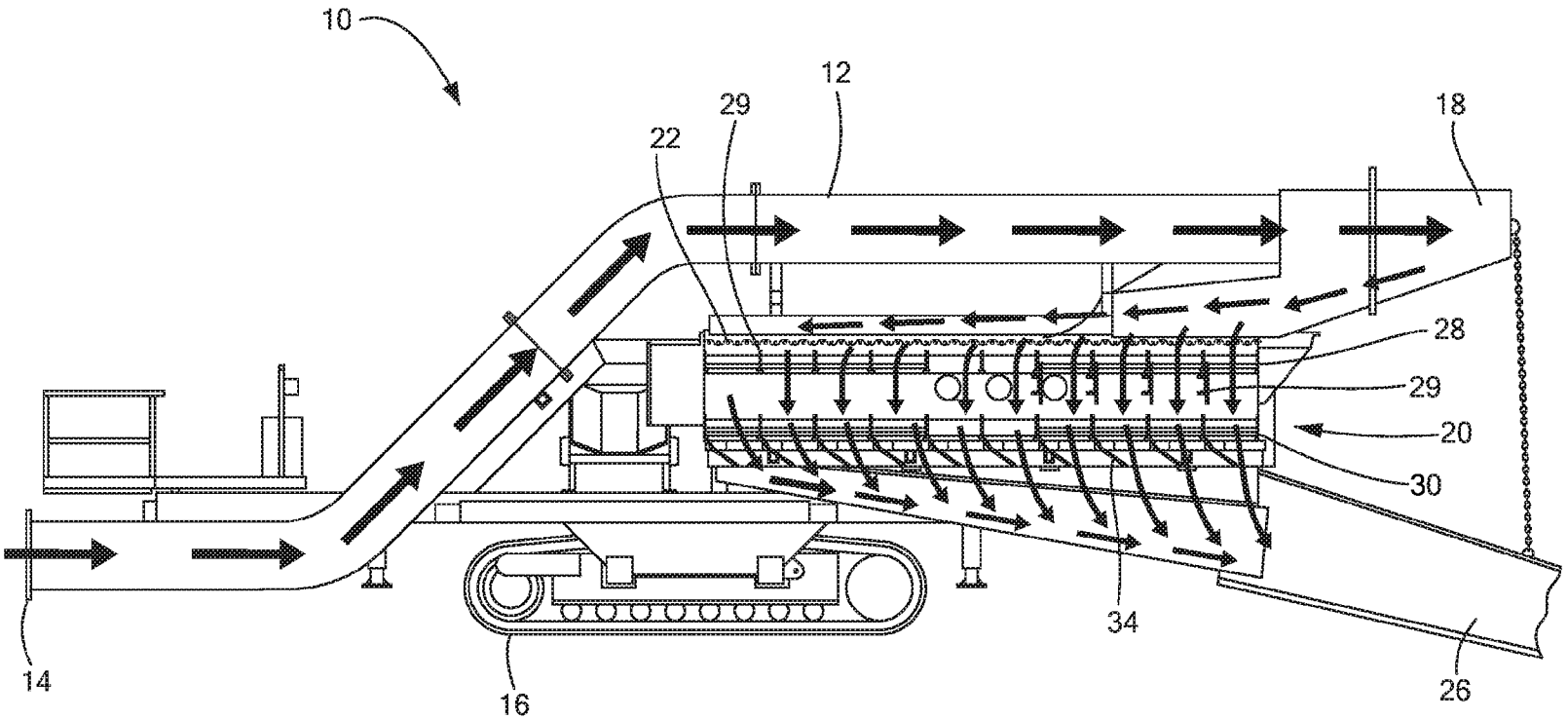
FIG. 2 is a side cut away view of the fluidized aggregate separation system of the present disclosure showing the flow of aggregate through the system.

FIG. 2 is a side cut away view of fluidized aggregate separation system 10 and uses arrows to illustrate the flow of aggregate through intake assembly 12 being redirected and slowed (illustrated by smaller arrows) by velocity reduction chamber 18, the larger material being separated from the separated aggregate by separation assembly 20 and the separated aggregate flowing down exit assembly 26 onto the restoration site. The arrows, starting at the open end 14 of intake assembly 12 and continuing up through the angled and level portions of intake assembly 12 indicate that aggregate is being pumped through intake assembly 12 towards velocity reduction chamber 18. The angled portion of intake assembly 12 could be at any different angle, i.e., 45 degrees, and can vary depending upon design requirements. When the aggregate mixture, which contains liquid, i.e., water, as well as different sized debris from the borrow area, enters velocity reduction chamber 18, it may, in certain instances, be travelling at excess speed. In order for separation assembly 20 to more efficiently separate larger material from the aggregate, velocity reduction chamber 18 serves to redirect and thus slow down the flow of aggregate as it travels from intake assembly 12 to separation assembly 20. In this fashion, and as described below in greater detail, the aggregate material is more evenly spread across screen assembly 22, facilitating the aggregate separation process.

FIG. 2 shows separation assembly 20 in greater detail. The arrows in FIG. 2 show the direction taken by the aggregate from open end 14 of intake assembly 12, through intake assembly 12 and velocity reduction chamber 18. The aggregate mixture then enters separation assembly 20, where the aggregate mixture travels over a vibrating screen assembly 22. Separation assembly 20 includes screen assembly 22, below which is located a deflector assembly, which, in some embodiments, includes an upper deck 28 having an array of deflectors 29 and a lower deck 30 having an array of deflectors 34. Upper deck 28 and lower deck 30 form the deflector assembly, which is configured to receive the separated aggregate that exits screen assembly 22 which is situated above the deflector assembly and to deflect the separated aggregate towards the exit assembly 26. It is within the scope of the present disclosure to include a deflector assembly with only one layer of deflectors rather than upper deck 28 or layer and lower deck or layer 30. For example, a deflector assembly could include single row of deflectors positioned such that the separated aggregate that exits screen assembly 22 is deflected down and into exit assembly 26.

Screen assembly 22 may include a plurality of apertures sized to allow certain sized material to drop through the screen on to the upper deck 28 which is situated below screen assembly 22. It is within the scope of this disclosure to provide a screen assembly 28 with apertures of different sizes according to design requirements. If it is desirable to allow larger material to restore the restoration site, then the apertures of screen assembly 28 can be larger to allow larger material to fall through. However, in certain instances only certain sized rocks or material are allowed on a restoration site due to, for example, environmental regulations. In these instances, the apertures of screen assembly 28 would be smaller. Throughout this disclosure, the term "oversized material" shall refer to material of the aggregate mixture that is too large to fit through the apertures in screen assembly 22 while "undersized material" shall refer to material of the aggregate mixture that is small enough to pass through the apertures of screen assembly 22. The sizes of the oversized material, the undersized material, and the apertures in screen assembly 22 may vary and the present disclosure shall not be limited to any particular sizes or dimension. As can be seen in FIG. 2, the arrows illustrate the passage of water and smaller particles through screen assembly 22 and on to a first layer of deflectors in upper deck 28. The deflectors 29 in upper deck 28 serve to protect the deflectors 34 in lower deck 30 by slowing the flow of separated aggregate (i.e., water and smaller material that has passed through screen 22 assembly). Deflectors 29, which may be vertically or substantially vertically disposed, also serve to direct the flow of water and separated aggregate down into lower deck 30 where the separated aggregate flow impinges upon deflectors 34 and are angled toward exit assembly 26. Deflectors 34 of lower deck 30 may be arranged to deflect the flow of separated aggregate towards exit assembly 26, and onto the restoration area.

Figure 3:
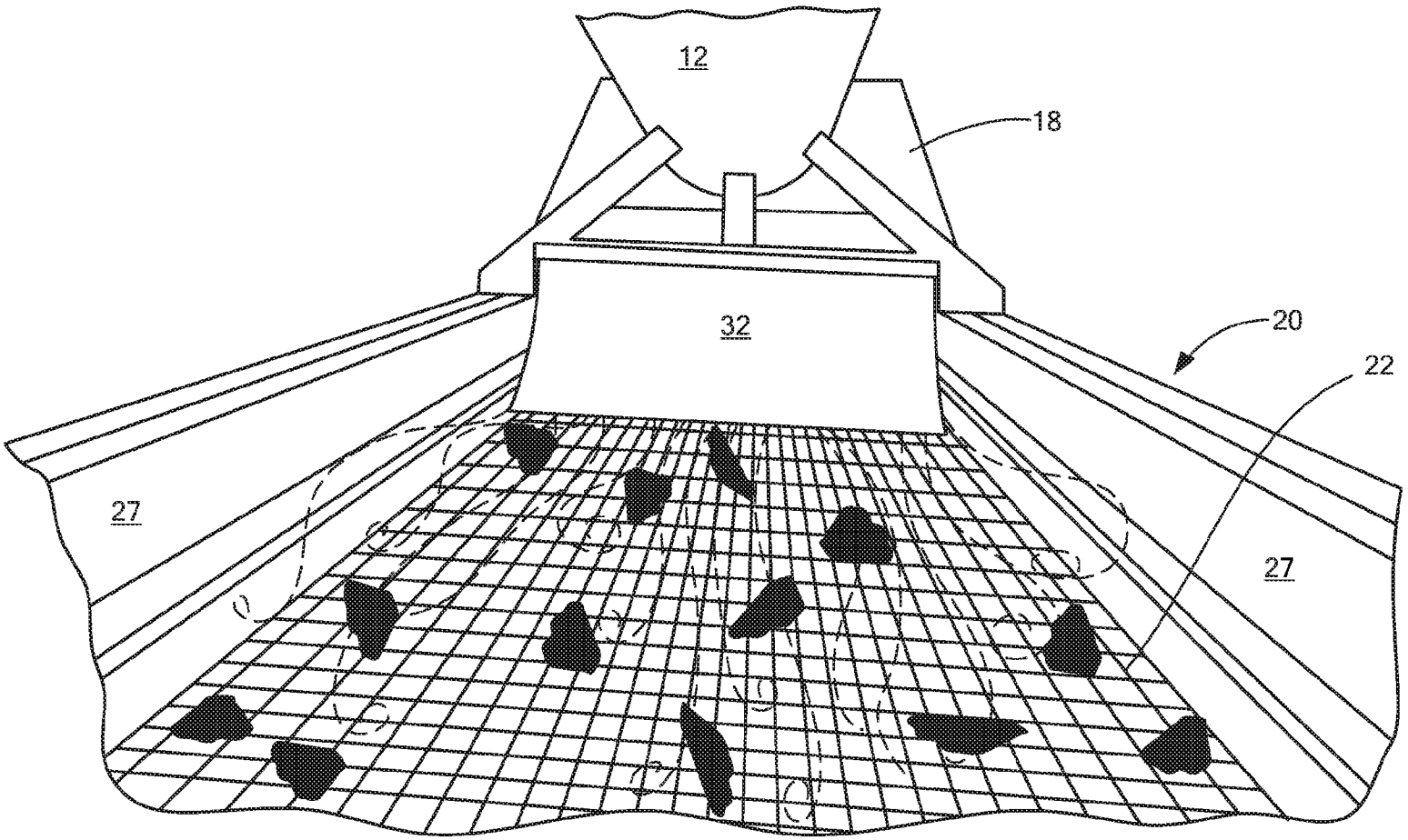
FIG. 3 is a top perspective view of the screen assembly of the separation assembly of the fluidized aggregate separation system of the present disclosure.

Referring now to FIG. 3, screen assembly 22 of separation assembly 20 can be seen in greater detail. Door 32 partially covers velocity reduction chamber 18. Door 32 serves as a flap to slow the velocity of the aggregate exiting velocity reduction chamber 18, yet allow the aggregate to flow out of velocity reduction chamber 18 and across screen assembly 22. Thus, aggregate, containing both oversized and undersized material, along with water exits door 32 and flows over screen assembly 22. In one embodiment, via the use of a drive assembly motor and belt (not shown) commonly known in the art, screen assembly 22 may be made to move or oscillate at a predetermined rate and direction. The movement of screen assembly 22 could be adjusted to move in any of a number of different directions. In one embodiment, screen assembly 22 moves in a combination of vertical and horizontal motion, i.e., an oval or elliptical movement. Advantageously, screen assembly 22 can be adjusted such that its stroke angle, stroke length, and screen speed can vary. The "stroke" is the actual repetitive movement of the screen assembly 22. The stroke angle is the angle of screen motion, for example 45 degrees, although any stroke angle can be utilized. The stroke length is the amplitude or distance the screen travels during each movement. For example, the stroke length might be ¾ of an inch for each stroke, although the present disclosure is not limited to any particular stroke length. The screen speed is the frequency that the screen travels through is range of motion, i.e., how often the screen moves. For example, the screen speed may be 740 revolutions per minute (RPM), although the present disclosure is not limited to any particular stroke length. A screen speed of 740 RMS and a stroke length of ¾ of an inch will result in approximately 4Gs of force.

The stroke angle, stroke length, and screen speed may be adjusted to allow for effective screening efficiency over a wide variety of applications and material conditions. Adjusting the stroke angle means changing the elliptical movement or "stroke" of the vibrating screen assembly 22 to one that is, for example, either more horizontal or more vertical. A more vertical oscillation stroke retains the material on screen assembly 22 longer and allows more time for material from the aggregate mixture to shake through the wire cloth of screen assembly 22. A more horizontal oscillation stroke moves the material across screen assembly 22 more rapidly, reducing the depth of the material along screen assembly 22. Thus, the vibration or stroke angle of screen assembly can be constantly adjusted in order to move the material across screen assembly 22 as fast as possible while at the same time screening out the greatest percentage of oversized material. Therefore, a combination of stroke angle, stroke length, and operation speed allows the user of fluidized aggregate separation system 10 to fine tune screen assembly 22 to fit particular applications and requirements until optimal screening efficiency can be achieved.

As seen in FIG. 3, larger, oversized material from the onrushing aggregate mixture exiting door 32 of velocity reduction chamber 18 is trapped on the outer surface of screen assembly 22 because the oversized material cannot fall through the smaller apertures in screen assembly 22. The smaller, separated aggregate that does fall through the apertures in screen 22 assembly enters the upper deck 28 of separation assembly 20 and then falls or is directed by deflectors 29 further below to lower deck 30 where angled deflectors 34 deflect the flow of separated aggregate out of fluidized aggregate separation system 10 via exit assembly 26. In some embodiments (shown, for example, in FIG. 5), lower deck 30 includes angled deflectors 34 as well as vertical deflectors. Thus, the present disclosure is not limited to the number of orientation of deflectors in upper deck 28 and lower deck 30. The purpose of the deflectors is to direct the flow of remaining aggregate towards the restoration site. Some of the deflectors may also serve the purpose of slowing the flow of aggregate and, in the case of upper deflectors 29 in upper deck 28, protect the lower deflectors 34 in lower deck 30 from the onrushing flow of aggregate.

In one embodiment, panels 27 affixed to one or both sides of screen assembly 22 may be used to prevent splashing of the flowing aggregate and to further maintain the aggregate mixture that exits velocity reduction chamber 18 within separation assembly 20 and, particularly, to assure that the aggregate mixture exiting door 32 travels across screen 22 and does not splash over the sides of fluidized aggregate separation system 10. Thus, separation assembly 20 continuously directs the separated aggregate that falls through the apertures in screen assembly 22 onto the restoration area while collecting oversized material that remains on screen assembly 22 (shown in FIG. 3) and directing the oversized material onto the conveyor belt of exit ramp 24 where the oversized material can be collected in a bin or vehicle and, if desired, carted away to a remote site. Screen assembly 22 can be of various dimensions according to project requirements. In one embodiment, screen 22 is 6 feet by 20 feet and has replaceable bottom panels. Removable screen panels in screen assembly 22 allows for easier and more efficient repairs during operation. Thus, a first screen assembly 22, having specific dimensions and aperture sized, may be easily replaced by subsequent screen assemblies 22 according to different design requirements as discussed above.

Figure 4:
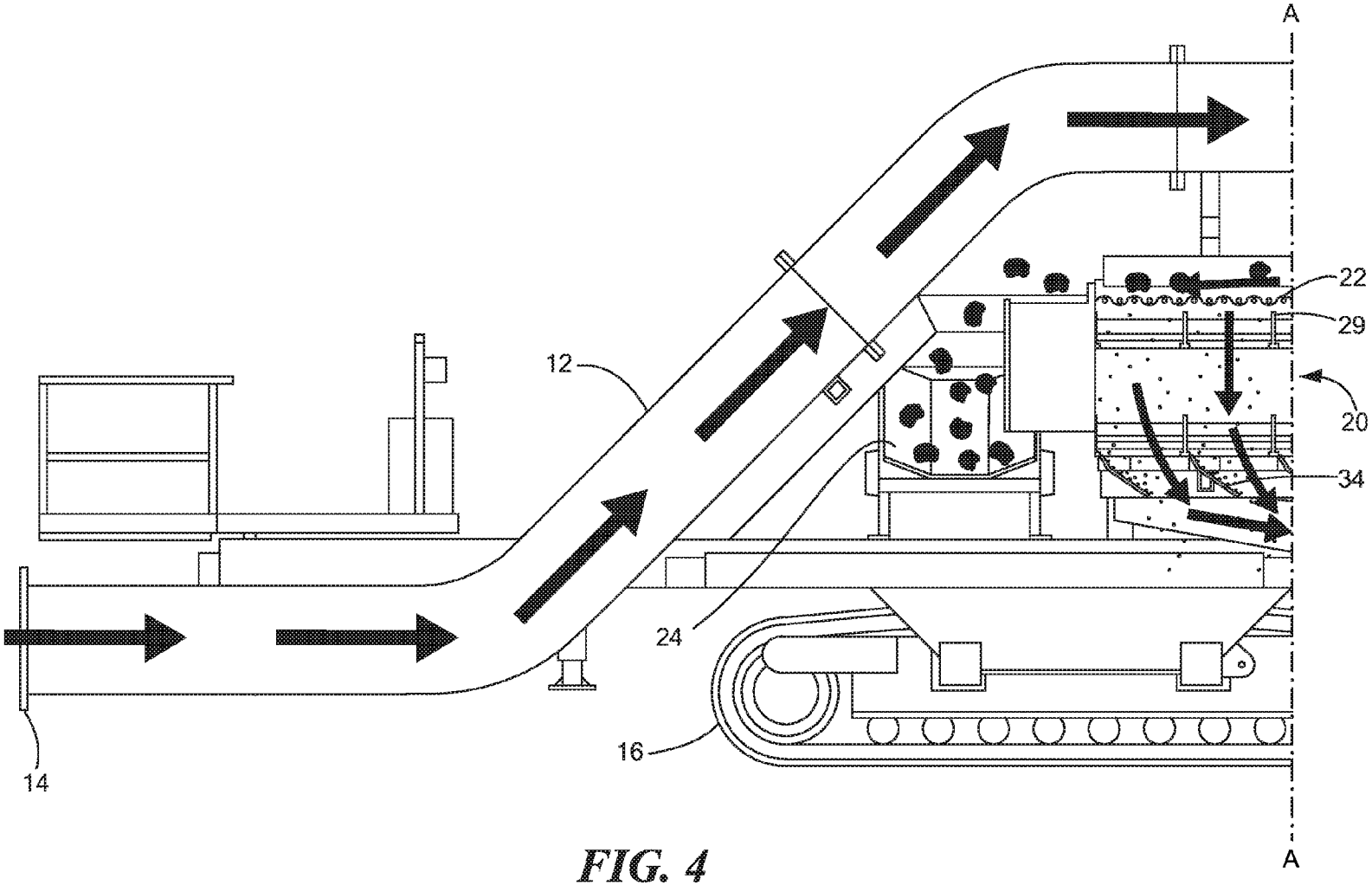
FIG. 4 is a partial side view of the fluidized aggregate separation system of the present disclosure showing the intake of aggregate through the intake assembly and separation of smaller material by the screen assembly.

FIG. 4 shows a cut-away view of the front intake portion of fluidized aggregate separation system 10 including the flow of aggregate entering intake assembly 12, the separation of oversized material from the aggregate and the passing of separated aggregate through screen assembly 22 and on to the upper deck 28 and lower deck 30 of separation assembly 20. Water and material pumped from a borrow area enter intake assembly 12 and flow up towards velocity reduction chamber 18 (not shown in FIG. 4). As described above, oversized material remains above screen assembly 22 of separation assembly 20 and due to the flow of water in the aggregate exiting velocity chamber 18 is forced on to the conveyor belt of oversized material exit ramp 24, where the material can drop into a collection bin, vehicle, or the like, for removal. The smaller, undersized separated aggregate falls through the apertures in screen assembly 22 where it enters upper deck 28 and then lower deck 30 where it is deflected by angled deflectors 34 towards exit assembly 26 (not shown in FIG. 4).

Figure 5:
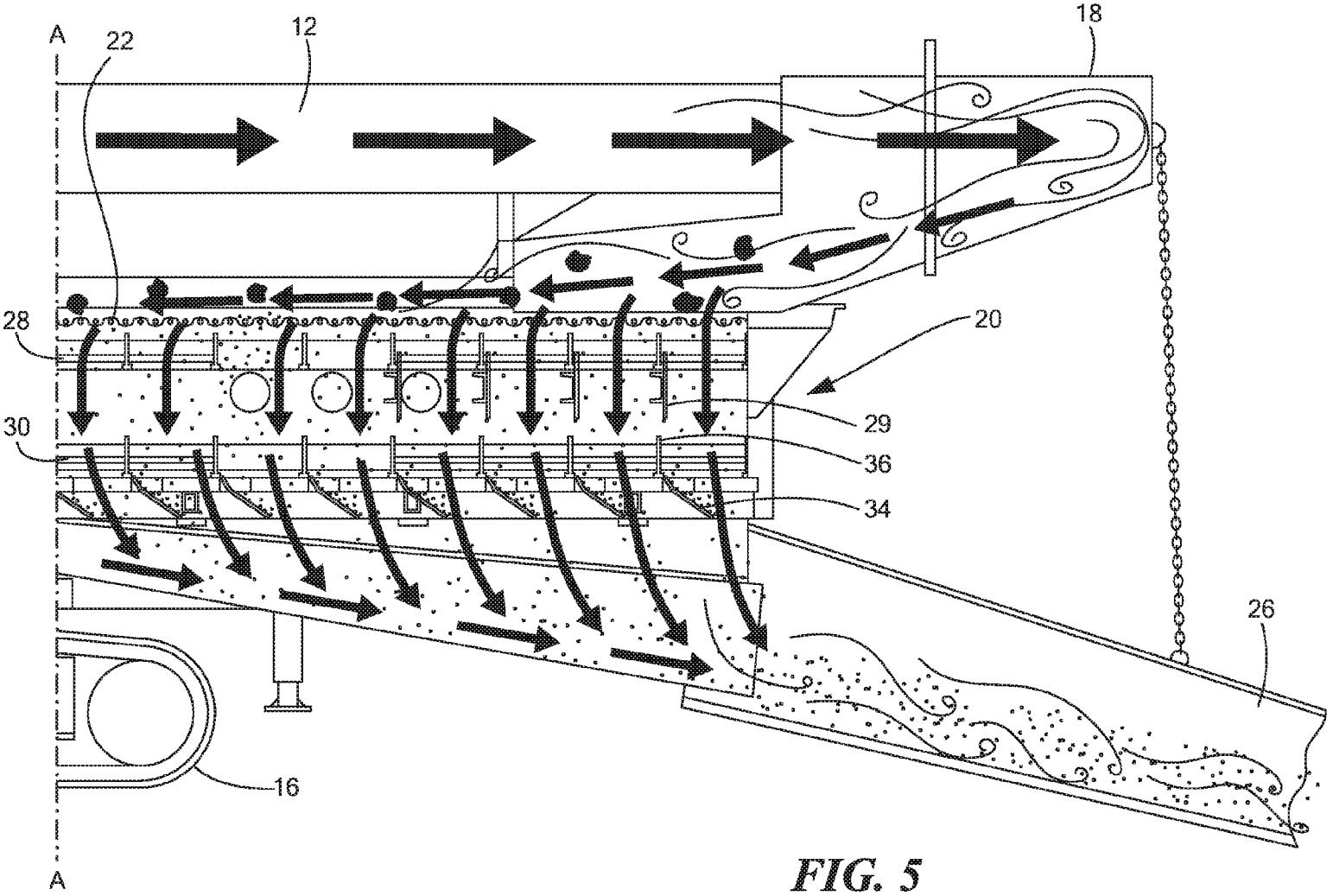
FIG. 5 is an alternate partial side view of the fluidized aggregate separation system of the present disclosure showing separation of the smaller material and directional flow of smaller material towards the exit assembly.

FIG. 5 illustrates the continuation of the flow of aggregate from intake assembly 12. Specifically, FIG. 5 shows a cut away view of the rear portion of fluidized aggregate separation system 10. When the aggregate enters velocity reduction chamber 18, it is redirected and slowed before entering separation assembly 20. FIG. 5 shows larger oversized material remaining above screen assembly 22, while smaller material along with the water falls through the apertures in screen assembly 22. The oversized material flows along the stop of screen assembly 22 and on to the conveyor portion of oversized material exit ramp 24. As described above, screen assembly 22 may be configured to vibrate at various speeds and in various directions in order to more efficiently allow the aggregate mixture to travel over screen assembly 22, allow undersized material to fall through the screen assembly 22 and on to the set of deflectors in upper deck 28 and lower deck 30 of separation assembly 20, and to prevent a large buildup of aggregated on screen assembly 22. The oversized material that cannot pass through screen assembly 22 flows along with the onrush of water exiting velocity reduction chamber 18 and drops down on to oversized material exit ramp 24 (not shown in FIG. 5).

Figure 6:
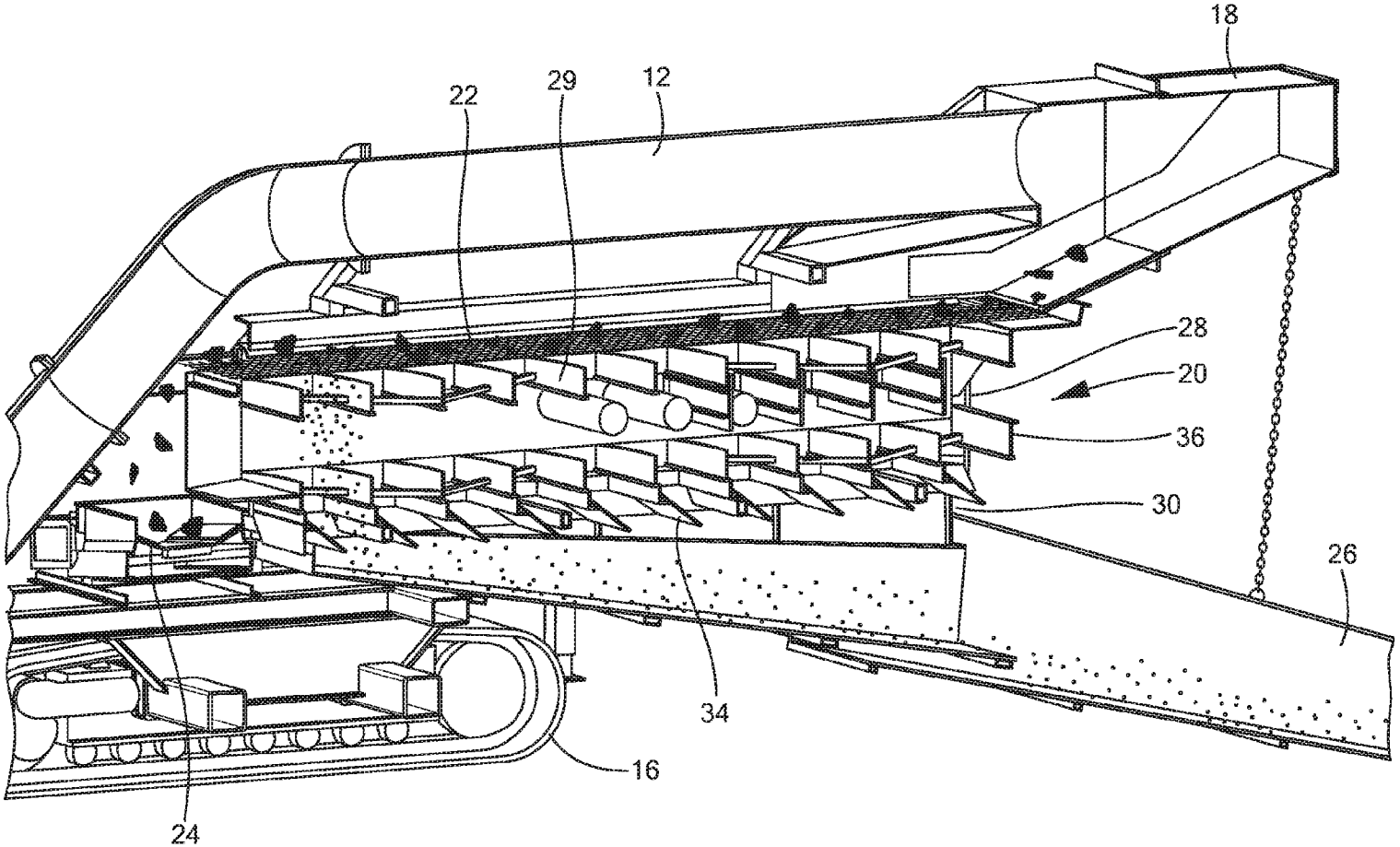
FIG. 6 is cut-away perspective view of the fluidized aggregate separation system of the present disclosure showing greater detail of the separation assembly and upper and lower deflectors.

FIG. 6 is a cut-away view of the rear portion of fluidized aggregate separation system 10, showing additional detail of separation assembly 20. As the aggregate mixture travels across screen assembly 22, the separated aggregate drops through screen assembly 22 and is directed in a substantially vertical direction by deflectors 29. The undersized material and water then contacts two sets of deflectors in lower deck 30. Vertical deflectors 36 are connected to angled deflectors 34. Vertical deflectors 36 serve to orient the separated aggregate falling through the apertures in screen assembly 22 in a vertical direction where they impinge upon a series of angled deflectors 34. As seen in FIG. 6, the separated aggregate is angled toward exit assembly 26 by the series of angled deflectors 34 and on to the restoration site.

In one embodiment of the present disclosure, intake assembly 12 includes two or more conduit pipes, each of which carries aggregate towards the velocity reduction chamber 18. The number of pipes can vary as needed. By using additional piping, the velocity of the aggregate being pumped from the borrow area to fluidized aggregate separation system 10 may be reduced to further increase the efficiency of velocity reduction chamber 18.

Once the contents of the aggregate mixture have been separated by separation assembly 20 and the separated aggregate has been deposited on the restoration area, fluidized aggregate separation system 10 can be moved toward a different location on the restoration site via movement assembly 16 and, if necessary, additional piping can be installed to the open end 14 of intake assembly 12 to form an extended pipeline. In this fashion, material can be deposited on a large restoration area or multiple restoration areas by continually filling the restoration area and moving fluidized aggregate separation system 10 forward, adding additional piping as needed, and repeating the aggregate separation process described herein until the entire site has been restored, leveled, etc. In one embodiment, the upper section of intake assembly 12 can be removed and transported separately to a different location on the restoration area. In another embodiment, each of the features of the fluidized rock screening system 10 of the present disclosure described herein may be operated either manually or by remote control.

It should be noted that fluidized aggregate separation system 10 may be used not only for beach or area restoration but also as a salvaging system to obtain items from a body of water. Thus, in another embodiment, the foreign debris or aggregate being dredged may be material that was deposited in the body of water but which parties are now seeking to obtain, such as, for example, ammunition or coal. For example, the military may wish to extract ammunition, or Munitions and Explosives of concern ("MEC") that was lost at sea. The fluidized aggregate separation system 10 of the present disclosure may be used in the same fashion as described herein in the context of beach restoration, for the salvaging of ammunition (or other material). Pieces of ammunition that are too large to pass through screen assembly 22 are trapped above it, and are captured by oversized material exit ramp 24.

It will be appreciated by persons skilled in the art that the present disclosure is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the disclosure, which is limited only by the following claims.

What is claimed is:

1. A fluidized aggregate separation system for separation of material in the aggregate larger than a predetermined size from material in the aggregate smaller than the predetermined size, the aggregate including a liquid, the aggregate separation system comprising:

an enclosed aggregate intake conduit assembly having a first and a second end, the enclosed aggregate intake conduit assembly allowing aggregate to travel in a first direction within the enclosed aggregate intake conduit assembly;

a velocity reduction chamber coupled to the second end of the enclosed aggregate intake conduit assembly and configured to receive the aggregate from the second end of the aggregate intake assembly, the velocity reduction chamber including a plurality of walls forming an enclosed receptacle, the velocity reduction chamber configured to reduce a velocity of the aggregate by redirecting the aggregate in a second direction opposite the first direction;

a separation assembly situated below the aggregate intake assembly and the velocity reduction chamber, the separation assembly configured to receive the aggregate exiting the velocity reduction chamber, the separation assembly comprising:

a continuous substantially horizontal screen assembly configured to prevent the material larger than the predetermined size from passing through the screen assembly and to allow the material smaller than the predetermined size to pass through the screen assembly; and a deflector assembly situated below the screen assembly, the deflector assembly comprising a first row of substantially vertical deflectors configured to slow the flow of aggregate and a second row of angled deflectors configured to redirect the aggregate exiting the first row of deflectors, the second row of deflectors positioned below the first row of deflectors; and an exit assembly configured to receive the material smaller than the predetermined size from the deflector assembly and to direct the material smaller than the predetermined size towards a restoration area.

2. The fluidized aggregate separation system of claim 1, wherein the screen assembly is configured to move at a predetermined rate, direction and distance.

3. The fluidized aggregate separation system of claim 1, further comprising at least one panel proximate the screen assembly, the at least one panel configured to prevent the aggregate from splashing outside the separation assembly.

4. The fluidized aggregate separation system of claim 1, further comprising a material exit ramp configured to receive the material larger than the predetermined size from the separation assembly and to continually transport the material larger than the predetermined size away from the restoration area.

5. The fluidized aggregate separation system of claim 4, wherein the oversized material exit ramp can be at least one of raised and lowered.

6. The fluidized aggregate separation system of claim 1, further comprising a movement assembly for allowing the fluidized aggregate separation system to be transported.

7. The fluidized aggregate separation system of claim 1, wherein the first end of the enclosed intake conduit assembly is adaptable to couple with at least one extension conduit to allow aggregate to be obtained from a different location.

8. The fluidized aggregate separation system of claim 1, wherein the enclosed intake conduit assembly comprises two or more enclosed conduits, each of the two or more enclosed conduits configured to receive aggregate from a location.

9. A site restoration system configured to receive aggregate, the aggregate including liquid, material larger than a predetermined size, and material smaller than the predetermined size, the site restoration system comprising:

at least one enclosed aggregate intake conduit each having a first and a second end, the first end of each of the at least one enclosed aggregate intake conduit configured to receive a flow of aggregate from a restoration site in a first flow direction;

a velocity reduction chamber coupled to the second end of the at least one enclosed aggregate intake conduit configured to receive the flow of aggregate from the second end of each of the at least one enclosed aggregate intake conduit, the velocity reduction chamber including a plurality of walls forming an enclosed receptacle, the velocity reduction chamber configured to reduce a velocity of the flow of aggregate by redirecting the flow of aggregate in a second flow direction opposite from the first flow direction;

a separation assembly situated below the at least one aggregate intake conduit and the velocity reduction chamber, the separation assembly configured to receive the flow of aggregate exiting the velocity reduction chamber, the separation assembly comprising:

a continuous substantially horizontal screen assembly configured to prevent the material larger than the predetermined size from passing through the screen assembly and to allow the material smaller than the predetermined size to pass through the screen assembly; and a deflector assembly situated below the screen assembly, the deflector assembly comprising a first row of substantially vertical deflectors configured to slow the flow of aggregate and a second row of angled deflectors configured to redirect the aggregate exiting the first row of deflectors, the second row of deflectors positioned below the first row of deflectors; and an exit assembly configured to receive the material smaller than the predetermined size from the deflector assembly and to transport the material smaller than the predetermined size towards the restoration site.

10. The site restoration system of claim 9, where the screen assembly is configured to move at a predetermined rate, direction and distance.

11. The site restoration system of claim 9, wherein the screen assembly moves in an elliptical orientation.

12. The site restoration system of claim 10, wherein the rate of movement of the screen assembly can be adjusted.

13. The site restoration system of claim 1, wherein the direction of movement of the screen assembly can be adjusted.

14. The site restoration system of claim 10, wherein the distance the screen assembly moves can be adjusted.

15. The site restoration system of claim 9, further comprising:

a material exit ramp configured to receive the material larger than the predetermined size from the separation assembly and to continually transport the material larger than the predetermined size away from the restoration site, the material exit ramp movable between a raised and a lowered position.

16. The fluidized aggregate separation system of claim 1, wherein the enclosed aggregate intake conduit assembly comprises an angled section positioned between the first end and the second end, the angled section configured to elevate a flow of aggregate.

* * * * *